United States Patent [19]

Ginsburg et al.

[11] 4,227,276

[45] Oct. 14, 1980

[54] TOOTHBRUSH WITH THERMALLY DEFORMABLE HANDLE

[76] Inventors: Stephen J. Ginsburg, 1478 Mark Twain Ct., Ann Arbor, Mich. 48103; Frederick E. Draheim, 4781 Surfwood Dr., Milford, Mich. 48042

[21] Appl. No.: 10,111

[22] Filed: Feb. 7, 1979

[51] Int. Cl.[3] ..... A46B 17/00

[52] U.S. Cl. ..... 15/176

[58] Field of Search ..... 15/167 R, 167 A, 176, 15/159 A

[56] References Cited

U.S. PATENT DOCUMENTS

| | | | |
|---|---|---|---|
| 651,841 | 6/1900 | Flemming | 15/159 A |
| 1,796,001 | 3/1931 | Church | 15/167 |
| 2,154,352 | 4/1939 | Peterson | 15/167 |
| 2,418,344 | 4/1947 | Goldberg | 15/187 |
| 2,438,268 | 3/1948 | Bressler | 15/167 |
| 2,445,657 | 7/1948 | Bennett | 15/167 |
| 2,527,931 | 10/1950 | Iskoe | 15/167 |
| 2,622,260 | 12/1952 | Vannice | 15/176 |
| 2,668,973 | 2/1954 | Glaza et al. | 15/176 |
| 2,706,825 | 4/1955 | Blakeman | 15/167 |
| 2,772,433 | 12/1956 | Brunda | 15/176 |
| 2,807,820 | 10/1957 | Dinhofer | 15/176 |
| 3,103,680 | 9/1963 | Krichmar | 15/167 |
| 3,271,805 | 9/1966 | Sawyer | 15/176 |
| 4,128,910 | 12/1978 | Nakata et al. | 15/167 R |

*Primary Examiner*—Leonard D. Christian
*Attorney, Agent, or Firm*—Krass and Young

[57] ABSTRACT

A toothbrush having a handle formed of a thermoplastic material with a glass transition temperature in the range of about 110°–140° F. The handle is heated to soften the plastic shaped to a desired configuration while pliable, then allowed to cool so as to retain the desired configuration when it hardens. The brush bristles may be detached from the handle when worn and replaced by a fresh set.

7 Claims, 8 Drawing Figures

TOOTHBRUSH WITH THERMALLY DEFORMABLE HANDLE

FIELD OF THE INVENTION

This invention relates to toothbrushes having handles formed of thermo-plastic material which may be molded by the use to an optimum configuration for brushing teeth.

PRIOR ART

Conventional toothbrushes have usually been formed with handles of straight, rigid sections of plastic intended to be employed in unaltered shape by the user. Because of differences in the size and shape of people's hands and in the alignment and placement of their teeth, a conventional toothbrush is uncomfortable and ineffective for many users, especially when brushing the posterior teeth.

Some toothbrushes have been produced with an angle or twist imparted to the handle to allow easier brushing of the rear teeth. While these brushes were well suited for some users, others found them less satisfactory than conventional toothbrushes, and a brush of this type suitable for a right-handed person would not work correctly for a left-handed person, so two different brushes would have to be produced and marketed.

A number of methods have been proposed for producing a toothbrush having a bristle portion that can be altered in shape in order to provide better contact with the teeth while brushing. As in Goldberg U.S. Pat. No. 2,418,344, Bressler U.S. Pat. No. 2,438,268 and Bennett U.S. Pat. No. 2,445,657, this was usually done by making a flexible bristle portion that would, when pressed against the inside or outside of a row of teeth, become convex or concave to match the surface of the teeth being brushed. One problem with this concept lies in the fact that the pressure that must be applied to conform the bristle portion to the teeth is not necessarily compatible with proper brushing techniques.

SUMMARY OF THE INVENTION

The present invention is broadly directed toward toothbrushes which may be formed to fit the hand and/or mouth of the user to provide for easier, more comfortable brushing. Moreover, the present invention is directed toward such a toothbrush having a detachable and replaceable brush portion so that the custom-formed handle portion need not be discarded when the brush bristles are worn and in need of replacement.

Toothbrushes of the present invention are substantially similar in appearance to conventional toothbrushes, the handle portion being of a length and cross-sectional size that can be comfortably held in an average-sized hand. The size and configuration of the brush portion is also similar to that of a conventional toothbrush, with a standard arrangement of the bristles.

Toothbrushes of the present invention are formed of a thermo-plastic having a glass transition temperature above any commonly-occurring atmospheric temperature, but below a temperature that will be uncomfortable or dangerous to the hand. Above this glass transition temperature, the toothbrush plastic becomes soft and easily moldable by hand into a near infinite variety of shapes. Bends, twists, etc., can be added to the handle to provide a comfortable fit for the hand or to produce a configuration allowing easier brushing of the teeth. When cooled below the glass transition temperature, the plastic sets firmly and rigidly into the desired shape and will hold that shape until reheated.

The preferred embodiment of the invention, which will subsequently be disclosed in detail, is formed of an acrylic and more specifically a polymer formed of a copolymer of methylmethacrylate and monomethylmethacrylate. This material has a glass transition temperature of about 115° F.

Other objectives, advantages and applications of the present invention will be made apparent by the following detailed description of several embodiments. The description makes reference to the accompanying drawings in which.

DETAILED DESCRIPTION

Figures 1, 2, 3, 4, 5, 6, 7, 8:
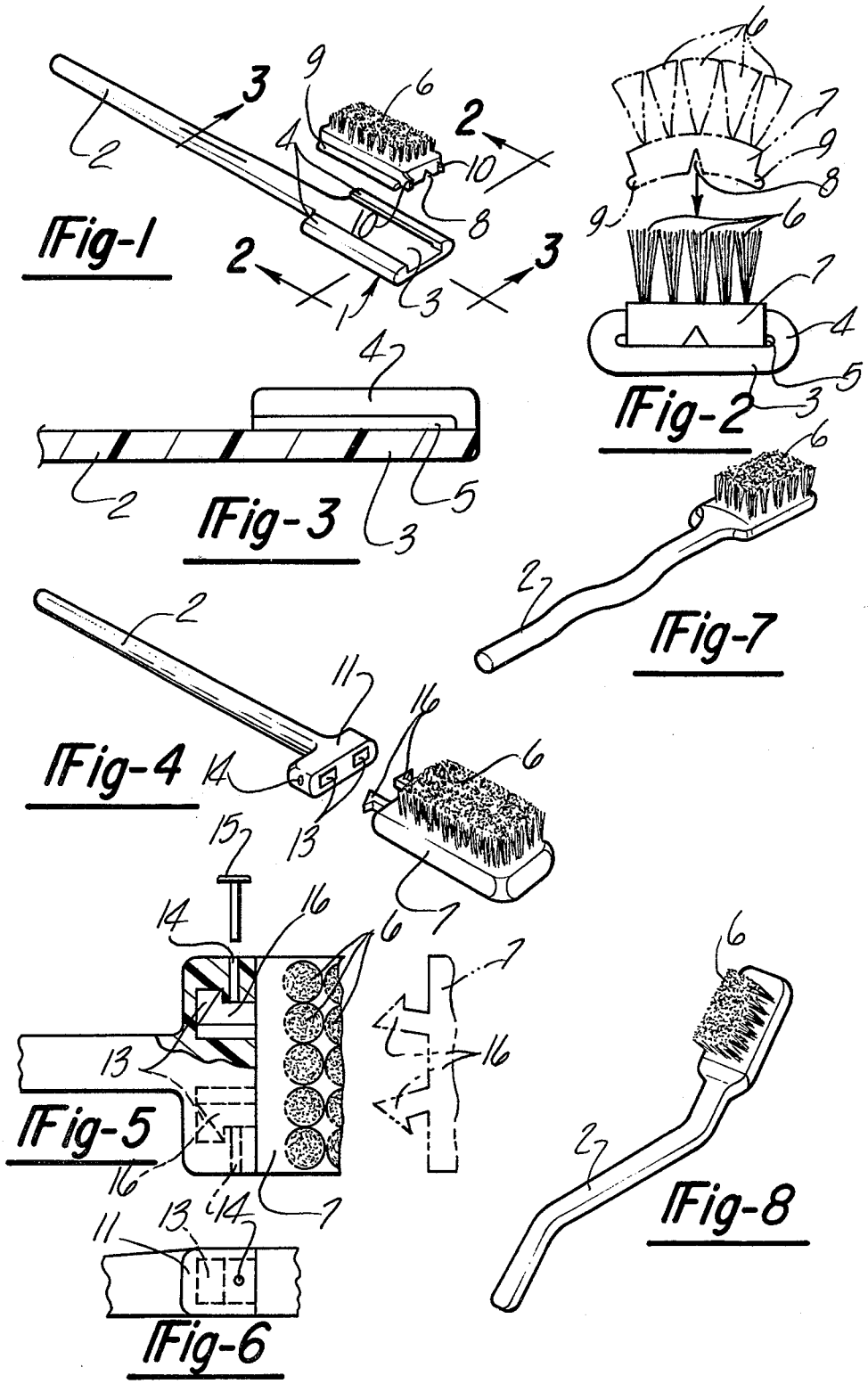
FIG. 1 is a perspective view of a preferred embodiment of the invention with the brush portion separate from the handle portion.
FIG. 2 is a sectional view taken on lines 2—2 of FIG. 1 showing the brush portion mounted to the handle portion and indicating the brush portion in a compressed state, ready to be mated to the handle portion.
FIG. 3 is a sectional view taken on lines 3—3 of FIG. 1.
FIG. 4 is a perspective view of the second embodiment of the invention with the brush portion separate from the handle portion.
FIG. 5 is a partial sectional view of the second embodiment showing the brush portion connected to the handle portion and indicating the brush portion before attachment.
FIG. 6 is a partial side view of the second embodiment.
FIGS. 7 and 8 are perspective views of either of the two embodiments showing possible configurations of the handle after forming of the thermo-plastic.

FIG. 1 shows the toothbrush of the present invention with the brush portion, generally indicated at A, positioned above the handle portion, generally indicated at B, as per the first embodiment to be described. The brush portion and handle portion are constructed so as to allow the two pieces to be joined firmly together while being used and to be quickly and easily separated when the brush portion is in need of replacement. The handle portion can be shaped by the user to provide a comfortable grip and to allow easier brushing of teeth in the back of the mouth. The handle portion is intended to be reused while the brush portion is disposed of when the bristles become worn out.

A brush portion receiving means, generally indicated at 1, is formed with or on the shaft 2 of the handle portion. The brush portion receiving means 1 comprises a flat bed 3 and grooves 5 in and running along the length of the sidewalls 4. Grooves 5 do not continue the entire length of the sidewalls 4, but rather stop short of reaching either end of the sidewalls 4.

The brush portion comprises bristles 6 held in a tray 7. Tray 7 is formed of a single piece of plastic material, not necessarily thermo-plastic, formed with a cleft 8 in the bottom, running substantially the entire length of the tray 7. Tray 7 is formed of a plastic material having sufficient stiffness and resiliency to allow the cleft 8 to be compressed and to return to its original shape afterward. Formed along either side of tray 7 are flanges 9 running substantially the entire length thereof and being of the same length as the grooves 5. At one end of the tray 7 and formed therewith are two knobs 10, one near each corner of tray 7.

In use, the brush portion is attached to the handle portion by applying pressure to the opposed, flange-bearing sides at the tray 7, partially closing cleft 8 and so narrowing the tray 7 as indicated in FIG. 2 and sliding the end of tray 7 into the bed 3. When the pressure is released, tray 7 widens, springing outward so that flanges 9 engage grooves 5 thereby securely holding the brush portion in the handle portion. To remove the brush portion, the user presses knobs 10 together with the fingers enough so that flanges 9 are clear of grooves 5 and the brush portion is pulled lengthwise out of the handle portion.

A second embodiment of the present invention has a brush portion receiving means formed with or on the shaft 2, and comprising a base 11 with two "L" shaped end holes 13 therein. Two small side holes 14 penetrate the base 11 laterally and contact the end holes 13.

The brush portion of this embodiment comprises bristles 6 held in tray 7. Tray 7 is a single piece of plastic material, not necessary thermo-plastic. At one end of tray 7 are two hooks 16, one protruding near each corner of tray 7. The hooks 16 are shaped and positioned to mate with holes 13 and, when hooks 16 are mated with holes 13, the brush portion is securely joined to the handle portion. To disconnect the two portions, the user inserts a pin 15 into each of the side holes 14 and by pressing inward on the pins 15, releases the hooks from their locked position in the end holes 13, allowing hooks 16 to be pulled out of holes 13.

To form the toothbrush to the individual user's needs, the shaft 2 is heated, preferably in a cup or a stream of hot water, to a temperature above its softening point (glass transition temperature). The user can then shape the shaft 2 to fit his/her grip, or twist or bend the handle portion to give the brush portion any desired orientation suitable for brushing of teeth as, for example, the shapes shown in FIGS. 7 and 8. The handle portion will harden within a relatively short period of time, i.e., 30 seconds to one minute, depending upon the exact plastic composition used, the thickness of the handle, and the ambient temperature. Hardening can be accelerated by placing the handle in cold water. The toothbrush can be reheated and reshaped a near infinite number of times.

Therefore, it is seen that the present invention provides a toothbrush of simple construction that can be inexpensively produced and that can be easily altered in shape to suit the individual needs of any user.

The embodiments of the invention in which an exclusive property or privilege is claimed are defined as follows:

1. A toothbrush comprising an elongated handle portion and a brush portion at one end of said handle portion, said handle portion being formed of thermo-plastic material having a glass transition temperature between approximately 110° F. and 140° F., whereby said handle portion may be heated to a temperature above its glass transition temperature, molded to a desired shape by manual manipulation while in a pliable state, then cooled to a temperature below its glass transition temperature, thereby rigidly fixing said handle portion in the desired shape.

2. The toothbrush of claim 1 in which said thermoplastic is an acrylic.

3. The toothbrush of claim 2 wherein the acrylic constitutes methylmethacrylate.

4. The toothbrush of claim 3 wherein the acrylic is a polymer of polymethylmethacrylate and monomethylmethacrylate.

5. The toothbrush of claim 1 including means to detachably connect said brush portion to said handle portion.

6. The toothbrush of claim 5 in which said connecting means comprises interlocking male and female components formed with or on said brush portion and said handle portion such that said portions may be manually connected to and disconnected from one another.

7. The toothbrush of claim 6 wherein said brush portion consists of:

a flat, rectangular bristle-bearing tray having a cleft in its underside running substantially the entire length of said tray;

a horizontal flange running the entire length of each of the two lateral sides of said tray; and a knob near each of the two corners of one end of said tray;

wherein said handle portion consists of:

an elongated shaft;

a flat, rectangular bed at one end of said shaft;

sidewalls extending vertically upward at the lateral edges of said bed and running the entire length of said bed, each sidewall having a horizontal groove along the inside, said grooves running marginally less than the length of said sidewalls, not extending through at either end, and being equal in length to said flanges on said brush portion, such that as pressure is applied to the opposed, flange-bearing sides of said brush portion, said cleft is compressed, narrowing said brush portion, and said brush portion is slid into said handle portion such that said flanges are engaged by and held securely in said grooves, removal of said brush portion from said handle portion being achieved by pressing said knobs inward toward one another, thereby narrowing said brush portion and sliding said flanges free at said grooves.

* * * * *